US008534090B2

(12) United States Patent
Sowder

(10) Patent No.: US 8,534,090 B2
(45) Date of Patent: Sep. 17, 2013

(54) COOLING SYSTEM FOR AN AUXILIARY DEVICE

(75) Inventor: William E. Sowder, Madrid, IA (US)

(73) Assignee: Solid Cooling, LLC, Madrid, IA (US)

( * ) Notice: Subject to any disclaimer, the term of this patent is extended or adjusted under 35 U.S.C. 154(b) by 1473 days.

(21) Appl. No.: 11/564,889

(22) Filed: Nov. 30, 2006

(65) Prior Publication Data

US 2008/0127653 A1 Jun. 5, 2008

(51) Int. Cl.
*F25D 3/12* (2006.01)

(52) U.S. Cl.
USPC ..... 62/384; 62/387; 62/388; 62/4; 165/156

(58) Field of Classification Search
USPC ..... 62/388, 384, 387, 4; 165/156
See application file for complete search history.

(56) References Cited

U.S. PATENT DOCUMENTS

| | | | | |
|---|---|---|---|---|
| 2,074,256 | A * | 3/1937 | Du Bois | 62/384 |
| 2,125,888 | A * | 8/1938 | Cordrey | 62/167 |
| 3,475,918 | A * | 11/1969 | Burton | 62/165 |
| 3,610,323 | A | 10/1971 | Troyer | |
| 3,670,518 | A | 6/1972 | Esposito | |
| 3,869,871 | A | 3/1975 | Rybalko et al. | |
| 4,191,028 | A | 3/1980 | Audet et al. | |
| 4,231,425 | A * | 11/1980 | Engstrom | 165/156 |
| 4,405,348 | A * | 9/1983 | Pasternack | 62/259.3 |
| 4,662,433 | A | 5/1987 | Cahn et al. | |
| 4,738,119 | A | 4/1988 | Zafred | |
| 4,998,415 | A | 3/1991 | Larsen | |
| 5,433,083 | A | 7/1995 | Kuramarohit | |
| 5,715,695 | A | 2/1998 | Lord | |
| 6,584,798 | B2 | 7/2003 | Schegerin | |
| 6,584,802 | B1 | 7/2003 | Cofield et al. | |
| 6,915,641 | B2 | 7/2005 | Harvie | |
| 2004/0069005 | A1 * | 4/2004 | Kyees | 62/390 |
| 2005/0139351 | A1 | 6/2005 | Chambers | |
| 2006/0053828 | A1 | 3/2006 | Shallman et al. | |

FOREIGN PATENT DOCUMENTS

| | | |
|---|---|---|
| JP | 09-047467 | 2/1997 |
| JP | 2004020138 | 1/2004 |

* cited by examiner

*Primary Examiner* — Brandon M Rosati
*Assistant Examiner* — Jonathan Koagel
(74) *Attorney, Agent, or Firm* — Zarley Law Firm, P.L.C.

(57) ABSTRACT

A system for cooling an auxiliary device having a main housing with at least one canister port, at least one fluid manifold mounted within the housing and in communication with the port, and a removable dry ice canister inserted in to the fluid manifold. Connected to the fluid manifold is a fluid line and connected to the canister is an air pressure line. Both the air pressure and fluid lines are connected to the pump. As the dry ice melts, it cools the fluid and creates pressure that activates the pump to pump fluid to the auxiliary device and back to the manifold for subsequent cooling.

20 Claims, 4 Drawing Sheets

COOLING SYSTEM FOR AN AUXILIARY DEVICE

BACKGROUND OF THE INVENTION

This invention relates to a cooling system and more particularly a cooling device that utilizes removable dry ice canisters for cooling an auxiliary device.

Dry ice, or carbon dioxide as a solid, has been used as a cooling agent for a variety of auxiliary devices. Typically a unit containing dry ice is connected to an auxiliary device and as the ice melts/evaporates, pressure builds forcing cool air or fluid through conduits from the unit to the auxiliary device.

These cooling systems have a number of deficiencies. For one, the units have limited dry ice capacity and are difficult to service when the dry ice melts. Also, in order to adequately cool a device for a desired period of time, large units that have greater capacity are needed which take up a considerable amount of space. Finally, with existing units cooling must be interrupted in order to service the unit. Accordingly, a need exists for a system that addresses these deficiencies.

An object of the present invention is to provide a cooling system that is easier to service.

Another object of the invention is to provide a cooling system that takes up less space.

Still another object of the invention is to provide a cooling system that can be serviced without interrupting the cooling process.

These and other objects will become apparent to one skilled in the art based on the following written description.

SUMMARY OF THE INVENTION

A system for cooling an auxiliary device having a main housing with at least one canister port, at least one fluid manifold mounted within the housing and in communication with the port, and a removable dry ice canister inserted in to the fluid manifold.

Connected to the fluid manifold is a fluid line and connected to the canister is an air pressure line. Both the air pressure and fluid lines are connected to the pump. As the dry ice melts, it cools the fluid and creates pressure that activates the pump to pump fluid to the auxiliary device and back to the manifold for subsequent cooling.

DETAILED DESCRIPTION OF THE PREFERRED EMBODIMENT

Figure 1:
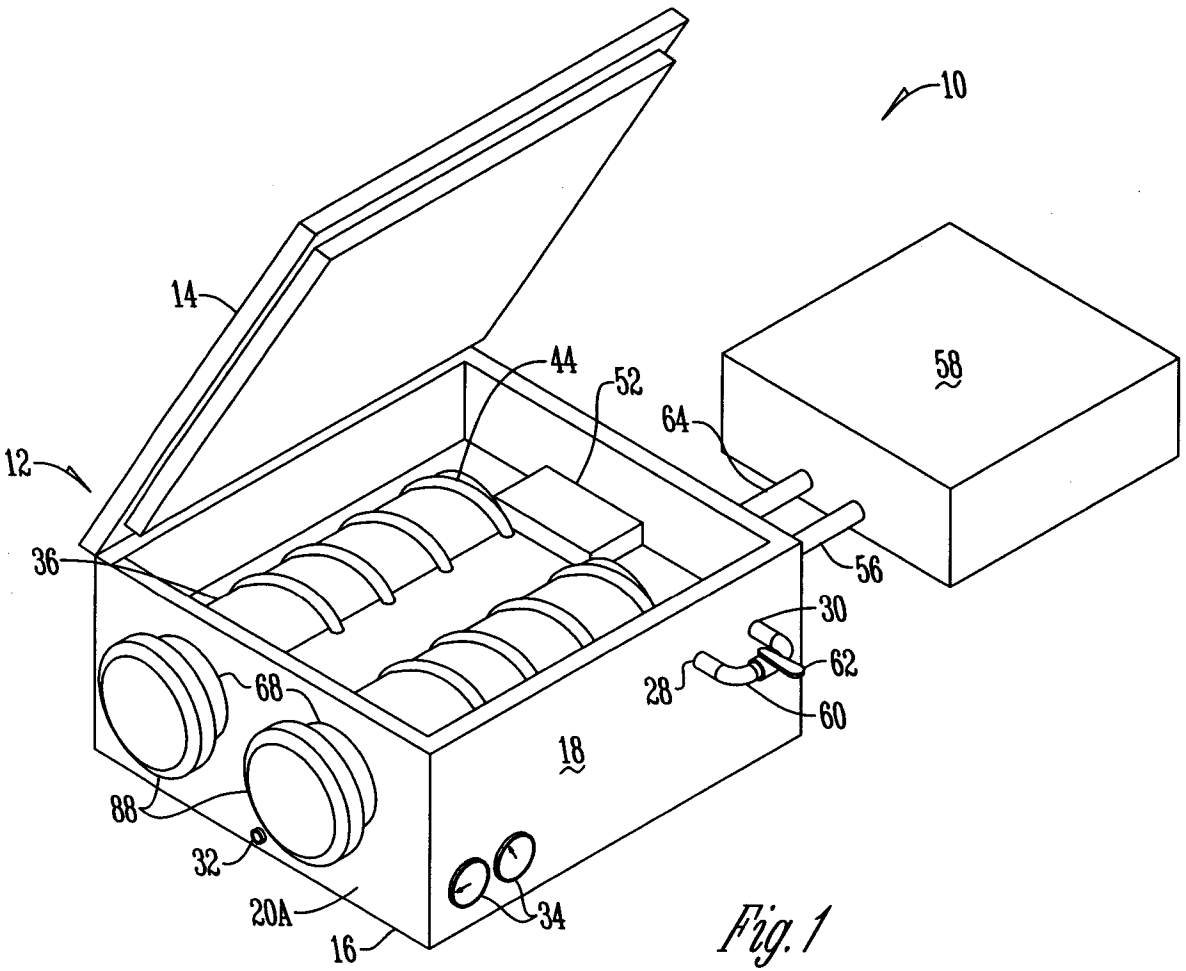
FIG. 1 is a perspective view of a cooling system.
Figure 2:
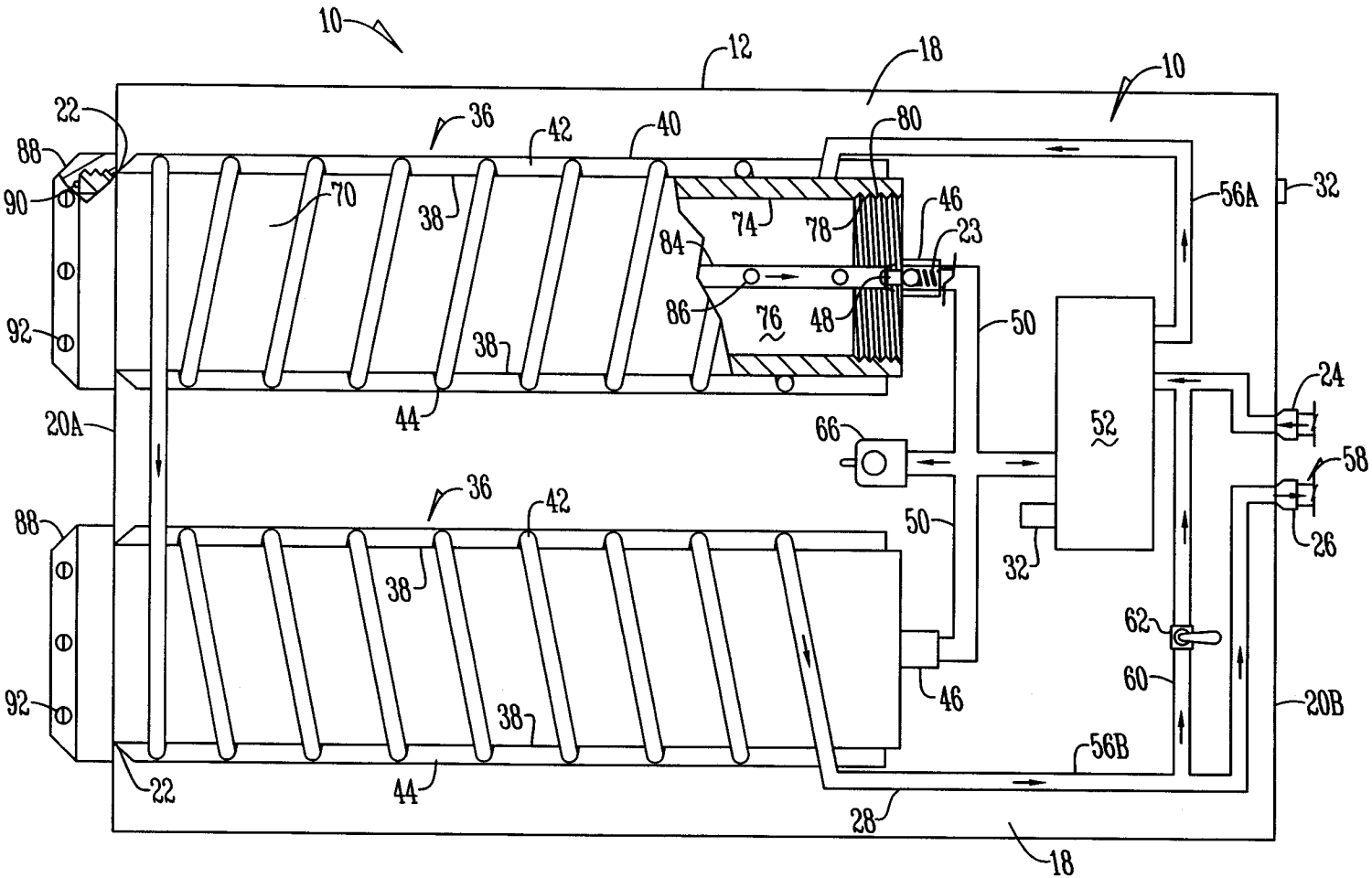
FIG. 2 is a sectional view of a cooling system.
Figure 3:
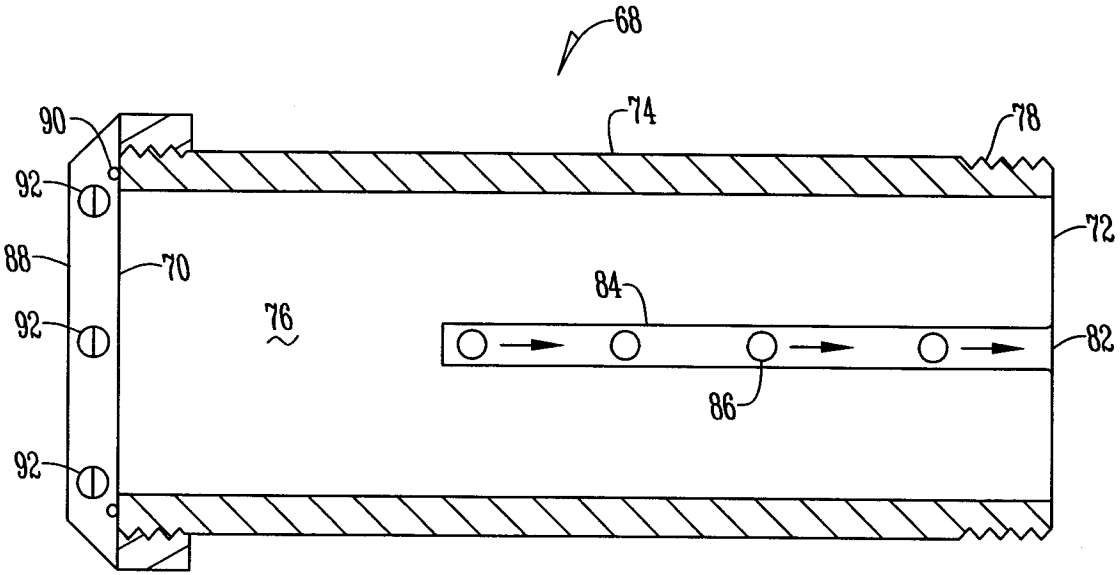
FIG. 3 is sectional view of a canister.
Figure 4:
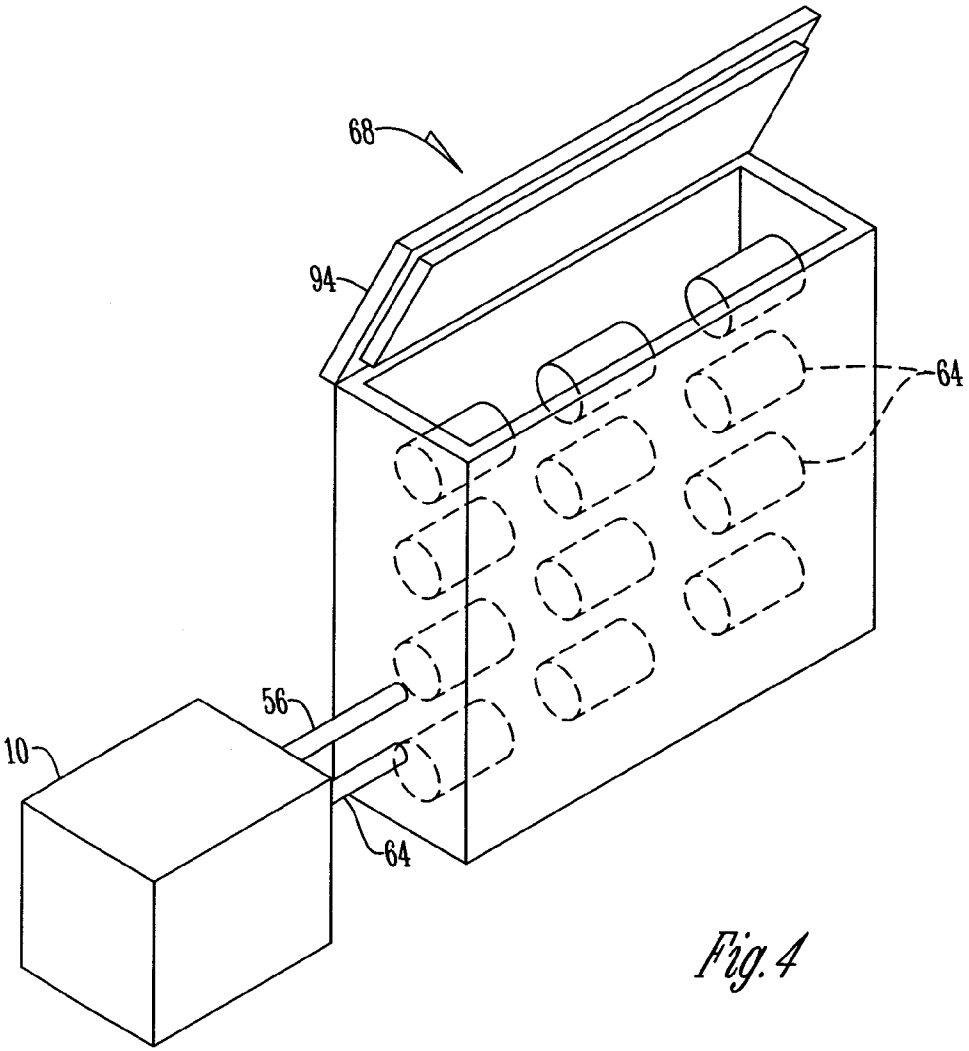
FIG. 4 is a perspective view of a cooler.

Referring to the Figures, the cooling system 10 has a main housing 12 having a top 14, a bottom 16, side 18 and end 20 walls. One end wall 20A has at least one container port 22 and the opposite end 20B has a pressure relief valve 23 that is connected to the system 10 and extends through the end wall 20B. Formed in either the side walls 18 or the end walls are additional ports including a fluid inlet port 24, a fluid outlet port 26, an inlet by-pass port 28, an outlet by-pass port 30, and an exhaust port 32. Optionally, a plurality of gauges 34 are mounted to the housing 12 for measuring air pressure and the temperature of the fluid flowing out to an auxiliary device.

Mounted within the housing 12 and in communication with the container port 22, is at least one fluid manifold 36. The manifold 36 has an inner wall 38 in spaced relation from an outer wall 40 to form a fluid chamber 42. The fluid chamber 42 has tubing 44 that is frictionally maintained between the inner and outer walls 38, 40 or alternatively, is hollow and connected to tubing 44 at one or more ends of the manifold 36. Any non-freezing cooling fluid is used in the system 10 such as methoglycol, glycol, or the like. The manifold 36 also has a fitting 46 at the end opposite the container port 22. The fitting 46 is of any shape such as a male prong 48 or a female receptacle that is connected to and in communication with an air pressure tube or conduit 50. The air pressure tube 50 is connected to the pressure check valve 23 and a pump 52. Preferably the pump 52 is an air/CO2 fluid pump having a 10-80 PSI capacity.

The cooling system 10 which is connected to pump 52 through inlet port 24 receives fluid to be cooled from auxiliary device 58. Fluid in line 56A is connected to outlet of pump 52 and transfers fluid to manifold 36. Fluid in line 44 is circulated, cooled, and travels to fluid outlet port 26 through fluid out line 56B. Cooled fluid is then circulated in auxiliary device 58 and returned to fluid inlet port 24. This sequence is then duplicated to continue the cooling process. In an alternative embodiment, by-pass manifold 60 is installed between fluid in line 56A, and fluid out line 56B. Restrictor valve 62 controls fluid by-passed back to pump 52, and fluid flow to auxiliary device 58 enabling temperature control of auxiliary device 58.

Connected between the auxiliary device 58 and the fluid manifold 36 is fluid line 64 that carries fluid from the auxiliary device 58 to the manifold 36 for cooling.

Formed to be received within fluid manifold 36 is a removable canister 68. The canister 68 has an open top 70, a closed bottom 72 and a side wall 74 that form a hollow chamber 76. On the outer surface of the side wall 74 adjacent the bottom 72 are threads 78 that are matingly received within threads 80 on the inner surface of the fluid manifold 36. Alternatively, the canister 68 is connected to the manifold 36 in any conventional manner. The bottom 72 has a tube 84 with a port 82 that extends from the chamber 76. Preferably the tube 84 has perforations 86. Connected to the tube 84 through port 82 is the pressure check valve 23. Releasably fitted to the open top 70 of canister 68 is a cap 88. The cap 88 is connected to the canister in any conventional way such as by threads, a frictional snap on fitting, or the like. Preferably, the cap 88 has an O-ring 90 that seals against the top edge 90 of sidewall 74. Also, for safety reasons, the cap is fitted with a poppet valve or pressure relief ports 92. A master pressure relief valve 66 is located in air pressure tube 50 manifold.

In operation, dry ice is placed within chamber 76 and the canister 68 is sealed by closing the open top 70 with cap 88. The canister 68 is then inserted into fluid manifold 36 such that threads 78 are matingly received by threads 80 and port 82 is in communication with air pressure tube 50. As the dry ice melts/evaporates the fluid in tubes 44 or chamber 42 is cooled and pressure is released into tube 50. If for some reason there is back pressure, pressure is released through cap 88 or master pressure relief valve 66.

Pressure from the canister 68 flows to pump 52. From the pressure the pump 52 is activated driving cooled fluid to manifold 36 through fluid in line 56A to fluid out line 56B to the auxiliary device 58. To increase the temperature in the auxiliary device the restrictor valve 62 is opened to allow cooled fluid to travel through by-pass line 60 back to pump 52. To reduce the temperature, the restrictor valve 62 is closed to restrict flow through line 60. Once fluid has reached the auxiliary device 58 for cooling, fluid returns to manifold 36 through line 64, and 56A for subsequent cooling.

Multiple manifolds 36 for receiving multiple canisters 68 may be connected to the system 10. In this way, while one canister 68 is being replaced, the other canisters 68 continue to provide pressure and cooling.

The system is connected to a number of different types of auxiliary devices such as a cooler, an automobile seat, a helmet, a shirt, or a suit.

Thus, a cooling system has been disclosed that, at the very least, meets all the stated objectives.

What is claimed is:

1. A system for cooling an auxiliary device comprising:

a main housing having a wall with a canister port disposed within the wall and a fluid line containing fluid adapted to be connected to the auxiliary device; a removable canister containing dry ice inserted into the housing through the canister port to cool the fluid and create pressure as the ice melts to drive fluid through the line; and the removable canister having a port wherein when the removable canister is inserted into the housing the port of the canister is placed in communication with the fluid line.

2. The system of claim 1 wherein the housing has a pump disposed therein that is activated by the pressure to drive fluid through the line.

3. The system of claim 1 wherein the housing has at least one fluid manifold in communication with the canister port for receiving the canister.

4. The system of claim 3 wherein the fluid manifold has an inner wall and an outer wall that form a fluid chamber.

5. The system of claim 3 wherein the fluid manifold has tubing frictionally maintained between an inner and an outer wall.

6. The system of claim 3 wherein the fluid manifold surrounds the canister.

7. The system of claim 1 wherein the canister has an open top and cap that seals the open top.

8. The system of claim 7 wherein the cap has pressure relief ports.

9. The system of claim 1 wherein the system has a pair of canisters and at least one canister is removable during operation.

10. A system for cooling an auxiliary device comprising:

a main housing having a canister port and a fluid line containing fluid adapted to be connected to the auxiliary device; and a canister containing dry ice, that is removable during operation, inserted into the housing to cool the fluid and create pressure as the ice melts to drive fluid through the line, such that when the canister is removed, the line continues to be provided pressure.

11. The system of claim 10 wherein the housing has a pump disposed therein that is activated by the pressure to drive fluid through the line.

12. The system of claim 10 wherein the housing has at least one fluid manifold in communication with the canister port for receiving the canister.

13. The system of claim 12 wherein the fluid manifold has an inner wall and an outer wall that form a fluid chamber.

14. The system of claim 12 wherein the fluid manifold has tubing frictionally maintained between an inner and an outer wall.

15. The system of claim 10 wherein the canister has an open top and cap that seals the open top.

16. The system of claim 15 wherein the cap has pressure relief ports.

17. The system of claim 10 wherein the system has a pair of canisters and one canister is removable during operation.

18. A system for cooling an auxiliary device comprising:

a main housing having a wall with a canister port disposed within the wall and a fluid line containing fluid adapted to be connected to the auxiliary device;

a removable canister containing dry ice inserted through the wall;

a fluid manifold surrounding the canister; and tubing extending around the circumference of the fluid manifold between an inner wall and an outer wall;

the removable canister having a port wherein when the removable canister is inserted into the housing the port of the removable canister is matingly received by a check valve.

19. The system of claim 18 wherein the inner wall and the outer wall of the fluid manifold form a fluid chamber.

20. The system of claim 18 further comprising the fluid manifold containing a non-freezing liquid.

* * * * *